US010059418B1

(12) United States Patent
Miles et al.

(10) Patent No.: US 10,059,418 B1
(45) Date of Patent: Aug. 28, 2018

(54) ADVANCED REMOTELY OPERATED VEHICLE FOR EDUCATION AND RESEARCH

(71) Applicant: The United States of America as represented by the Administrator of the National Aeronautics and Space Administration, Washington, DC (US)

(72) Inventors: Ted K. Miles, Onancock, VA (US); Geoffrey L. Bland, Parksley, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 15/432,486

(22) Filed: Feb. 14, 2017

(51) Int. Cl.

| | |
|---|---|
| ***B63H 25/04*** | (2006.01) |
| ***B63B 35/00*** | (2006.01) |
| ***B63H 7/02*** | (2006.01) |
| ***B63B 3/48*** | (2006.01) |
| ***B63H 25/38*** | (2006.01) |
| *B63H 25/02* | (2006.01) |

(52) U.S. Cl.
CPC ..... *B63H 25/04* (2013.01); *B63B 3/48* (2013.01); *B63B 35/00* (2013.01); *B63H 7/02* (2013.01); *B63H 25/381* (2013.01); *B63B 2003/485* (2013.01); *B63B 2035/008* (2013.01); *B63B 2201/16* (2013.01); *B63B 2213/00* (2013.01); *B63H 2025/028* (2013.01)

(58) Field of Classification Search
CPC ..... B63H 25/04; B63H 7/02; B63B 35/00; B63B 3/48; B63B 2035/008
USPC ..... 701/2
See application file for complete search history.

(56) References Cited

U.S. PATENT DOCUMENTS

| | | | | |
|---|---|---|---|---|
| 4,322,208 | A * | 3/1982 | Kelpin | B60F 3/0007 114/144 R |
| 6,014,940 | A * | 1/2000 | Jacobson | B60V 1/22 114/271 |
| 6,413,125 | B1 * | 7/2002 | Duer | B63H 7/02 440/37 |
| 7,090,549 | B2 * | 8/2006 | Garcia | B63H 7/02 114/61.1 |
| 2005/0164569 | A1 * | 7/2005 | Kaji | B63H 21/21 440/1 |
| 2013/0340668 | A1 * | 12/2013 | Robertson | B63B 27/146 114/343 |

* cited by examiner

*Primary Examiner* — Tan Q Nguyen
(74) *Attorney, Agent, or Firm* — Heather Goo; Bryan A. Geurts; Mark P. Dvorscak

(57) ABSTRACT

Disclosed are watercrafts with rotatable air propulsion steering units and retractable measurement instruments. The watercraft can include a substantially flat bottom, a top deck, a rotatable air propulsion steering unit configured to propel the watercraft and to rotate in order to steer the watercraft when the watercraft is submerged in a liquid body without requiring a submerged rudder steering system under the substantially flat bottom. The watercraft can also include a retractable measurement deck configured to alternatively raise measurement instruments above the liquid body and lower into the liquid body.

24 Claims, 4 Drawing Sheets

ADVANCED REMOTELY OPERATED VEHICLE FOR EDUCATION AND RESEARCH

BACKGROUND

1. Technical Field

The present disclosure relates to watercrafts with rotatable air propulsion steering units.

2. Introduction

The present disclosure relates to watercrafts with rotatable air propulsion steering units. Known watercraft that use air propulsion involve fixed-position, on-deck air propulsion fans that propel the watercraft in a single direction and that use a steerable, submerged rudder to control the direction of the watercraft. Also, watercrafts used for gathering water quality data typically involve submerged instruments. However, the submerged rudder and instruments prevent the watercraft from entering shallow water or water with vegetation or other objects near the surface of the water. What is needed are watercrafts that utilize air propulsion systems that do not require submerged rudder systems and watercraft that can collect water quality data that do not require permanently submerged instruments.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are watercrafts with rotatable air propulsion steering units and retractable measurement instruments. The watercraft can include a substantially flat bottom, a top deck, a rotatable air propulsion steering unit configured to propel the watercraft and configured to rotate in order to steer the watercraft when the watercraft is submerged in a liquid body without requiring a submerged rudder steering system under the substantially flat bottom. The watercraft can also include a retractable measurement deck configured to alternatively raise and lower measurement instruments into the liquid body.

In some cases, the rotatable air propulsion steering unit is a ducted propulsion fan positioned near the center of the watercraft. In some cases, the rotatable air propulsion steering unit involves a pair of unducted propulsion fans positioned in the aft-end, starboard side of the watercraft and the aft-end, port side of the watercraft, respectively. The watercraft can include a remote control, a radio, an electronic controller and actuators used to receive navigational controls and rotate the rotatable air propulsion steering units to steer the watercraft. The watercraft can also include an actuator that is controlled by the electronic controller and that can cause the retractable measurement instruments to alternatively be raised above the surface of a liquid body and become submerged in the liquid body. The measurement instruments can include a thermometer for detecting a temperature of the liquid body, a depth meter for detecting a depth of the liquid body, a dissolved oxygen meter for detecting an amount of dissolved oxygen in the liquid body, a nitrate meter for detecting an amount of nitrates in the liquid body, a salinity meter for detecting an amount of saline in the liquid body, etc. The watercraft can also include a camera. The camera can capture image frames and the electronic controller can process, store, and transmit the image frames.

DETAILED DESCRIPTION

Figure 1:
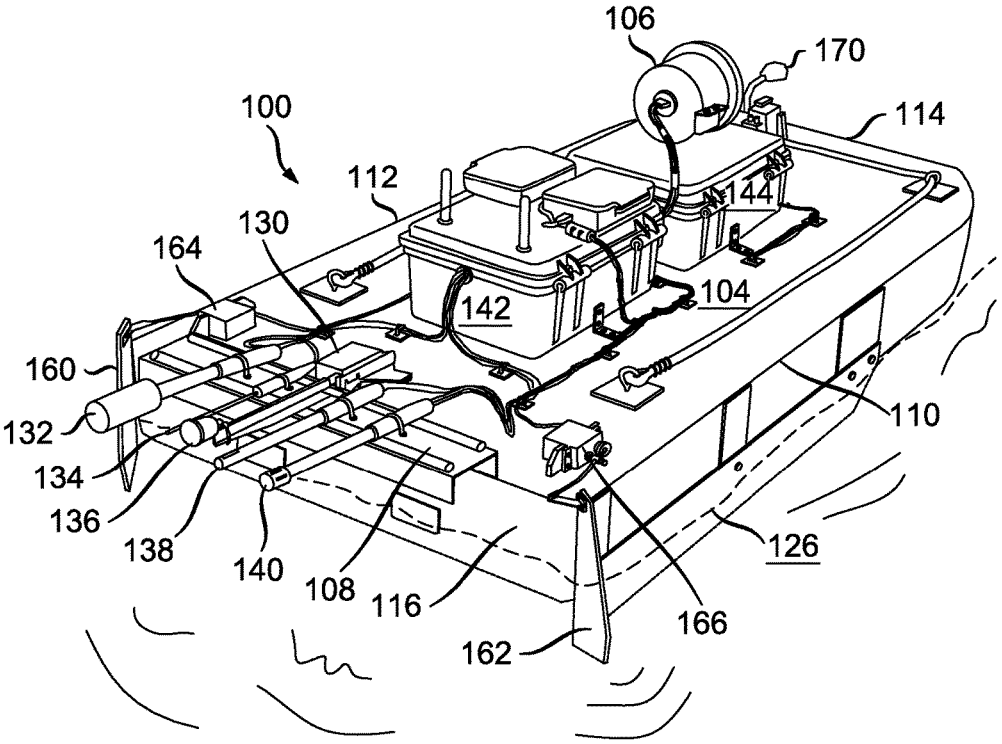
FIG. 1 illustrates the watercraft with the retractable measurement deck actuated to in a non-submerged position.

Disclosed are watercrafts with rotatable air propulsion steering units and retractable measurement instruments. FIG. 1 illustrates a watercraft 100 having a substantially flat bottom (not shown), a top deck 104, a rotatable air propulsion steering unit 106, and a retractable measurement deck 108. The watercraft 100 is buoyant and floats on a surface 126 of a liquid body. The watercraft 100 has a port side 110, a starboard side 112, a fore end 114, and an aft end 116.

The rotatable air propulsion steering unit 106 is positioned on the top deck 104 and is configured to propel the watercraft in a direction that the rotatable air propulsion steering unit 106 is facing. The rotatable air propulsion steering unit 106 is also configured to rotate in order to steer the watercraft 100 when the watercraft 100 is submerged in a liquid body without requiring a submerged rudder steering system under the substantially flat bottom. In some cases, a side rudder system can be additionally employed with side rudders 160, 162 controlled by actuators 164, 166 and an electronic controller (described below). However, the side rudders 160, 162 can minimally extend into the liquid body and only minimally interfere with vegetation or other obstacles below the surface 126 of the liquid body. Also, the side rudders 106, 162 can be excluded from the watercraft 100 and the rotatable air propulsion steering unit 106 can provide all propulsion and steering function for the watercraft 100.

The rotatable air propulsion steering unit 106 can comprise a ducted air propulsion fan substantially centered between the port side 110 and the starboard side 112. Also, the rotatable air propulsion steering unit 106 can rotate in an arc in order to steer the watercraft 100. For example, in some cases, the rotatable air propulsion steering unit 106 can rotate in an arc from a fore-facing position, through a starboard-facing position, through an aft-facing position, to a port-facing position. Also, the rotatable air propulsion steering unit 106 can be positioned at a height selected to avoid the rotating fan from interfering with other components (described below) on the top deck 104.

Figure 2:
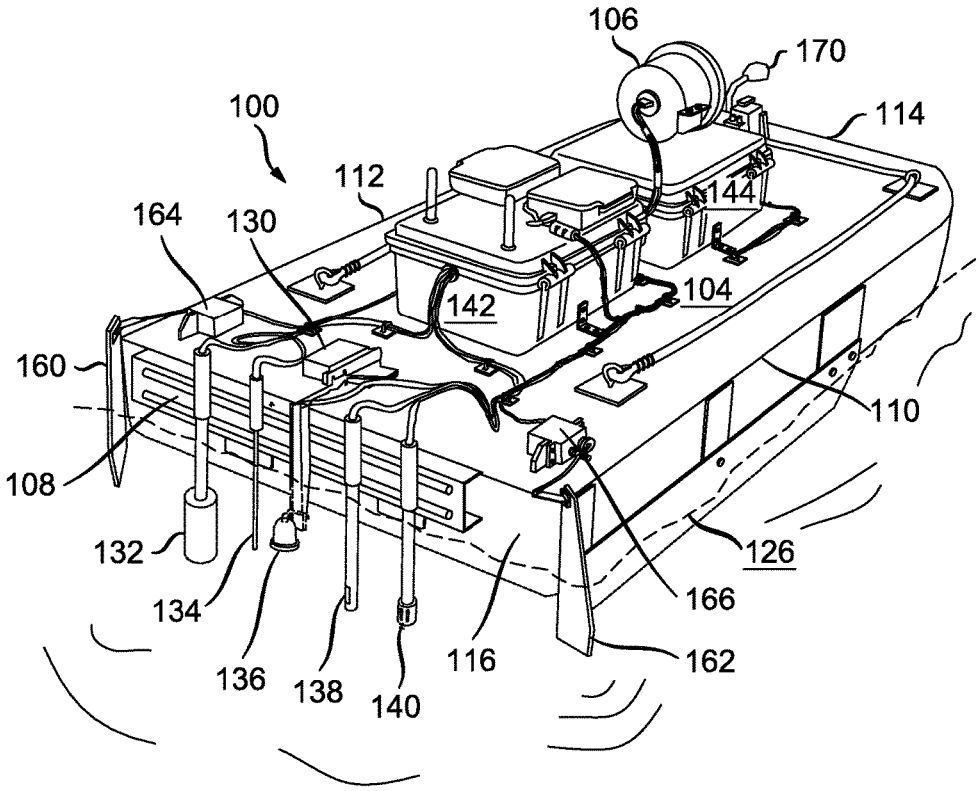
FIG. 2 illustrates the watercraft with the retractable measurement deck actuated to a submerged position.

The watercraft 100 can also include one or more actuator 130 that actuates to place the retractable measurement deck 108 in one or more positions. The retractable measurement deck 108 can serve as a support and attachment base for one or more measurement instruments 132, 134, 136, 138, 140 that are used to measure qualities of a liquid body that the watercraft 100 is floating on. As shown in FIG. 1, the retractable measurement deck 108 is in a non-submerged position and the measurement instruments 132, 134, 136, 138, 140 are held above the surface 126 of the liquid body. FIG. 2 illustrates the watercraft 100 with the retractable measurement deck 108 actuated to a submerged position. When the retractable measurement deck 108 is in a submerged position the measurement instruments 132, 134, 136, 138, 140 are similarly submerged in the liquid body.

In some cases, the measurement instruments 132, 134, 136, 138, 140 can include a thermometer for detecting a temperature of the liquid body, a depth meter for detecting a depth of the liquid body, a dissolved oxygen meter for detecting an amount of dissolved oxygen in the liquid body, a nitrate meter for detecting an amount of nitrates in the liquid body, a salinity meter for detecting an amount of saline in the liquid body, etc. Although these specific measurement instruments are listed explicitly, those with ordinary skill in the art having the benefit of the present disclosure will readily appreciate that a wide variety of measurement instruments (now known or later developed) can be used in conjunction with the disclosed technology.

The watercraft 100 can be configured to be controlled remotely and to take water quality measurements, process, and transmit the measurements. As shown in FIGS. 1-2, the watercraft 100 includes control boxes 142, 144 containing control instruments (described in greater detail below) for remote control, measurement automation, computer processing, radio transmission, etc.

Figure 3:
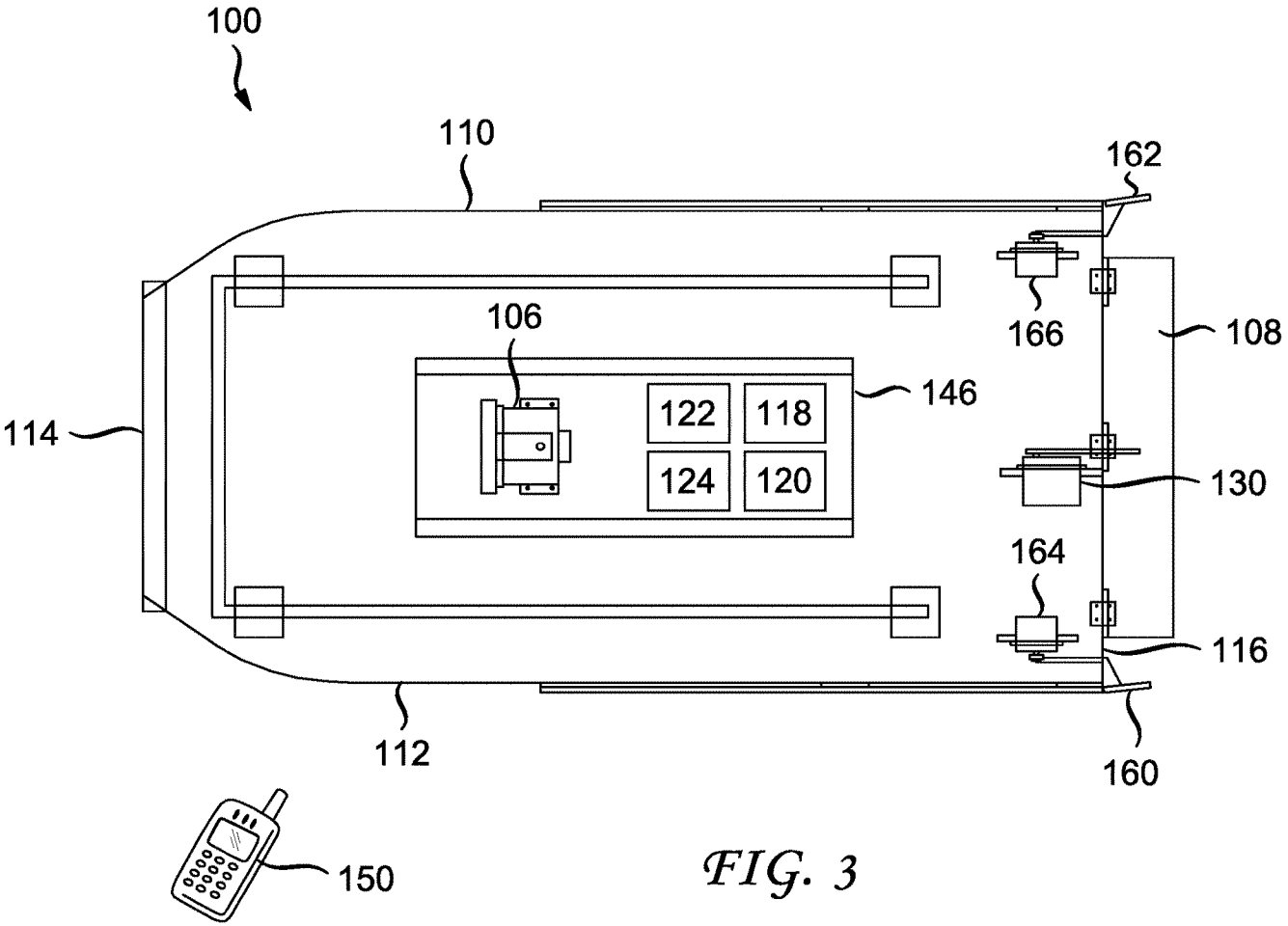
FIG. 3 illustrates a top view of a watercraft with a control box containing control instruments.

FIG. 3 illustrates a top view of a watercraft 100 with a control box 146 with a box diagram representation of control instruments including a power source 118, an electronic controller 120, an on-board steering control unit 122, and a radio 124. Those with ordinary skill in the art having the benefit of the present disclosure will readily appreciate that control instruments can be physically or communicatively coupled to achieve the functionality described herein. The radio 124 can be configured to receive, from a remote control system 150, navigational instructions. The radio can further be configured to transmit the navigational instruction to the electronic controller 120. Further, the electronic controller 120 can be configured to process received navigational instructions and provide the on-board steering control unit 122 with propulsion and rotation instructions which cause the rotatable air propulsion steering unit 106 to propel and steer the watercraft 100.

Likewise, the actuator 130 can be coupled with the electronic controller 120 and the actuator 130 can receive, from the electronic controller 120, deck articulation instructions for lowering the retractable measurement deck 108 into the liquid body and for raising the retractable measurement deck 108 above the liquid body. The deck articulation instructions can be received, via the radio 124, from the remote control unit 150.

Similarly, the measurement instruments 132, 134, 136, 138, 140 can be coupled with the computer system 120 and when the measurement instruments 132, 134, 136, 138, 140 measure a quality of the liquid body, the electronic controller 120 can process, store, and transmit the measurements.

Also, the watercraft 100 can include a camera 170 coupled with the computer system 120. For example, as shown in FIGS. 1-2 above, a camera 170 can be mounted to the top deck 104 facing the fore end 114 of the watercraft 100. The camera 170 can capture image frames and the electronic controller 120 can process, store, and transmit the image frames.

Embodiments within the scope of the present disclosure may also include tangible and/or non-transitory computer-readable storage media for carrying or having computer-executable instructions or data structures stored thereon. Such tangible computer-readable storage media can be any available media that can be accessed by a general purpose or special purpose computer, including the functional design of any special purpose processor as described above. By way of example, and not limitation, such tangible computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection to a computer, the computer properly views the connection as a computer-readable medium. Thus, any such connection is properly termed a computer-readable medium.

Computer-executable instructions include, for example, instructions and data which cause a general purpose computer, special purpose computer, or special purpose processing device to control a group of components to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Other embodiments of the disclosure may be practiced in network computing environments with many types of computer system configurations, including an electronic controller that can process pulse-width modulation signals into fan rotational instructions, personal computers, hand-held devices, multi-processor systems, microprocessor-based or programmable consumer electronics, network PCs, mini-computers, mainframe computers, and the like. Any such computing device will include the basic hardware components such as a processor, a bus, memory, input/output devices, and so forth. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Figure 4:
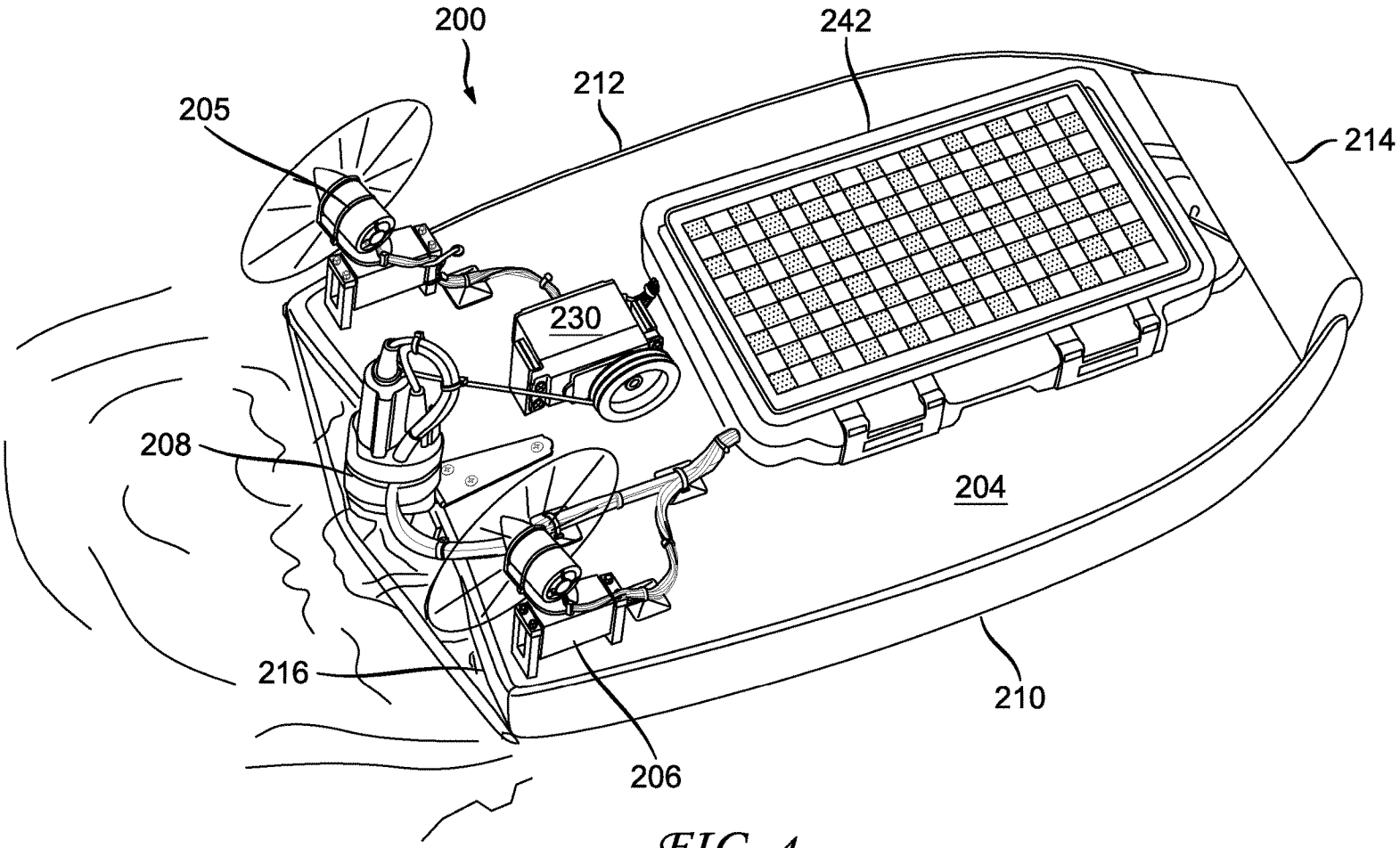
FIG. 4 illustrates a watercraft with a pair of rotatable air propulsion steering units.

FIG. 4 illustrates a watercraft 200 having a substantially flat bottom (not shown), a top deck 204, a pair of rotatable air propulsion steering units 205, 206, and a retractable measurement cylinder 208. The watercraft 200 is buoyant and floats on a surface 226 of a liquid body. The watercraft 200 has a port side 210, a starboard side 212, a fore end 214, and an aft end 216.

The pair of rotatable air propulsion steering units 205, 206 are positioned at the aft 216 end and the port 212 side and at the aft 216 end and starboard 210 side, respectively. Also, the pair of rotatable air propulsion steering units 205, 206 can be unducted fans configured to propel and steer the watercraft 200 by independently rotating. Also, the rotatable air propulsion steering units 205, 206 can be positioned at a height selected to avoid the rotating fan from interfering with other components (described below) on the top deck 204.

The watercraft 200 also has one or more actuator 230 that articulates measurement instruments (not shown) within the retractable measurement cylinder 208 into non-submerged and submerged positions. The watercraft 200 can also include a control box 242 containing control instruments (described above) for remote control, measurement automation, computer processing, radio transmission, etc.

The various embodiments described above are provided by way of illustration only and should not be construed to limit the scope of the disclosure. Various modifications and changes may be made to the principles described herein without following the example embodiments and applications illustrated and described herein, and without departing from the spirit and scope of the disclosure.

We claim:

1. A watercraft, the watercraft comprising:

a substantially flat bottom;

a top deck;

a rotatable air propulsion steering unit positioned on the top deck and configured to propel the watercraft and to rotate in order to steer the watercraft when the watercraft is submerged in a liquid body without requiring a submerged rudder steering system under the substantially flat bottom;

a retractable measurement deck configured to alternatively raise above the liquid body and lower into the liquid body;

a power source;

an electronic controller; and an on-board steering control unit configured to receive a rotation instruction from the electronic controller and cause the air propulsion steering unit to rotate according to the instructions.

2. The watercraft of claim 1, wherein the top deck has a port side and a starboard side, and wherein the rotatable air propulsion steering unit further comprises a ducted propulsion fan substantially centered between the port side and the starboard side.

3. The watercraft of claim 2, wherein the rotatable air propulsion steering unit is configured to rotate in an arc from a fore-facing position, through a starboard-facing position, through an aft-facing position, to a port-facing position.

4. The watercraft of claim 1, the watercraft further comprising:

a radio communicatively coupled with the electronic controller, wherein the radio is configured to receive, from a remote control system, a navigational instruction, and wherein the radio is configured to transmit the navigational instruction to the electronic controller.

5. The watercraft of claim 4, wherein the electronic controller is configured to translate the navigational instruction into the rotation instruction.

6. The watercraft of claim 4, the watercraft further comprising:

an actuator coupled with the retractable measurement deck, wherein the actuator configured to alternatively raise the retractable measurement deck above the liquid body and lower the retractable measurement deck into the liquid body.

7. The watercraft of claim 6, wherein the actuator is communicatively coupled with the electronic controller, and wherein the actuator is configured to receive, from the electronic controller, a deck articulation instructions for towering and raising the retractable measurement deck.

8. The watercraft of claim 7, wherein the electronic controller is configured to receive, from the remote control system via the radio, the deck articulation instructions.

9. The watercraft of claim 1, wherein the retractable measurement deck further comprises a thermometer coupled with electronic controller, wherein the thermometer is configured to detect a temperature of the liquid body, and wherein the electronic controller is configured to convert the temperature into a temperature measurement and store the temperature measurement.

10. The watercraft of claim 1, wherein the retractable measurement deck further comprises a depth meter coupled with electronic controller, wherein the depth meter is configured to detect a depth of the liquid body, and wherein the electronic controller is configured to convert the depth into a depth measurement and store the depth measurement.

11. The watercraft of claim 1, wherein the retractable measurement deck further comprises a dissolved oxygen meter coupled with electronic controller, wherein the dissolved oxygen meter is configured to detect an amount of dissolved oxygen in the liquid body, and wherein the electronic controller is configured to convert the amount of dissolved oxygen into a dissolved oxygen measurement and store the dissolved oxygen measurement.

12. The watercraft of claim 1, wherein the retractable measurement deck further comprises a nitrate meter coupled with electronic controller, wherein the nitrate meter is configured to detect an amount of nitrate in the liquid body, and wherein the electronic controller is configured to convert the amount of nitrate into a nitrate level measurement and store the nitrate level measurement.

13. The watercraft of claim 1, wherein the retractable measurement deck further comprises a saline meter coupled with electronic controller, wherein the saline meter is configured to detect an amount of saline in the liquid body, and wherein the electronic controller is configured to convert the amount of saline into a saline level measurement and store the saline level measurement.

14. The watercraft of claim 1, the watercraft further comprising:

a camera mounting to the top deck facing a fore-position, the camera configured to capture image frames, wherein the electronic controller is configured process and store the image frames, and wherein the radio is configured to transmit the image frames.

15. The watercraft of claim 1, wherein the top deck has an aft end, a fore end, a port side and a starboard side, wherein the rotatable air propulsion steering unit further comprises a first unducted propulsion fan positioned at the aft end and the starboard side and a second unducted propulsion fan positioned at the aft end and the port side.

16. The watercraft of claim 15, wherein the first unducted propulsion fan is configured to rotate in an arc including a first position facing towards the starboard side, a second position facing the aft end, and a third position facing the port side.

17. The watercraft of claim 16, wherein the first unducted propulsion fan is positioned at a height above the top deck such that the first unducted propulsion fan does not interfere with the top deck when rotated in the third position facing the port side.

18. The watercraft of claim 15, wherein the second unducted propulsion fan is configured to rotate in an arc including a first position facing the port side, a second position facing the aft end, and a third position facing the starboard side.

19. The watercraft of claim 18, wherein the second unducted propulsion fan is positioned at a height above the top deck such that the second unducted propulsion fan does not interfere with the top deck when rotated in the third position facing the starboard side.

20. A watercraft, the watercraft comprising:

a substantially flat bottom;

a top deck;

a rotatable air propulsion steering unit positioned on the top deck and configured to propel the watercraft and to rotate in order to steer the watercraft when the watercraft is submerged in a liquid body without requiring a submerged rudder steering system under the substantially flat bottom; and a retractable measurement deck configured to alternatively raise above the liquid body and lower into the liquid body, wherein the top deck has an aft end, a fore end, a port side and a starboard side, wherein the rotatable air propulsion steering unit further comprises a first unducted propulsion fan positioned at the aft end and the starboard side and a second unducted propulsion fan positioned at the aft end and the port side.

21. The watercraft of claim 20, wherein the first unducted propulsion fan is configured to rotate in an arc including a first position facing towards the starboard side, a second position facing the aft end, and a third position facing the port side.

22. The watercraft of claim 21, wherein the first unducted propulsion fan is positioned at a height above the top deck such that the first unducted propulsion fan does not interfere with the top deck when rotated in the third position facing the port side.

23. The watercraft of claim 20, wherein the second unducted propulsion fan is configured to rotate in an arc including a first position facing the port side, a second position facing the aft end, and a third position facing the starboard side.

24. The watercraft of claim 23, wherein the second unducted propulsion fan is positioned at a height above the top deck such that the second unducted propulsion fan does not interfere with the top deck when rotated in the third position facing the starboard side.

* * * * *